US005886329A

United States Patent [19]

Kim

[11] Patent Number: 5,886,329

[45] Date of Patent: Mar. 23, 1999

[54] ANTIBIOTIC MICROWAVE OVEN

[75] Inventor: Hyang-Gi Kim, Suwon, Rep. of Korea

[73] Assignee: Samsung Electronics Co., Ltd., Suwon

[21] Appl. No.: 980,619

[22] Filed: Dec. 1, 1997

[30] Foreign Application Priority Data

Jun. 27, 1997 [KR] Rep. of Korea ..... 97-28368

[51] Int. Cl.[6] ..... H05B 6/80

[52] U.S. Cl. ..... 219/756; 219/725; 99/DIG. 14

[58] Field of Search ..... 219/756, 725; 99/451, DIG. 14

[56] References Cited

FOREIGN PATENT DOCUMENTS 3-79919 4/1991 Japan ..... 219/756

3-150122 6/1991 Japan .

6-264520 9/1994 Japan .

7-275262 10/1995 Japan .

8-193342 7/1996 Japan .

*Primary Examiner*—Philip H. Leung

*Attorney, Agent, or Firm*—Burns, Doane, Swecker & Mathis, L.L.P.

[57] ABSTRACT

An antibiotic microwave oven for cooking a foodstuff within its cooking chamber utilizing high frequency energy, including an antibiotic layer provided to the cooking chamber for killing bacteria bred within the cooking chamber contaminated by the foodstuff being cooked and for preventing the propagation of harmful microbes. The antibiotic layer is formed of zeolite-Ag, thus killing *escherichia coli, salmonella typhimurium, pseudomonas aeruginosa*, and *bacillus alvei*.

1 Claim, 2 Drawing Sheets

ANTIBIOTIC MICROWAVE OVEN

BACKGROUND OF THE INVENTION

1. Field of the Invention

The present invention relates to a microwave oven having an antibiotic effect. More particularly, it relates to an antibiotic microwave oven whose interior is coated with a material containing a substance that kills harmful bacteria and eumycetes.

2. Discussion of Related Art

As shown in FIG. 1, a microwave oven includes a main body 10, a cooking chamber 20 provided to one side of main body 10 and in which a foodstuff F to be cooked is placed, a door 30 opening and closing cooking chamber 20, a control panel 40 provided to the other side of main body 10 for controlling the electrical components, a turntable 50 rotating foodstuff F placed on a tray of cooking chamber 20 to be cooked by high frequency energy.

When cooking using the conventional microwave oven, foodstuff F in cooking chamber 20 may boil over or spatter, thus making cooking chamber 20 dirty, which breeds harmful eumycetes and bacteria within cooking chamber 20.

SUMMARY OF THE INVENTION

Accordingly, the present invention is directed to an antibiotic microwave oven that substantially obviates one or more of the problems due to limitations and disadvantages of the related art.

It is an object of the present invention to provide an antibiotic microwave oven whose interior is coated with coated with a material containing a substance that kills harmful bacteria and germs.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, there is disclosed an antibiotic microwave oven for cooking a foodstuff within its cooking chamber utilizing high frequency energy, including an antibiotic layer provided to the cooking chamber for killing bacteria bred within the cooking chamber contaminated by the foodstuff being cooked and for preventing the propagation of harmful microbes. The antibiotic layer is formed of zeolite-Ag, thus killing *escherichia coli, salmonella typhimurium, pseudomonas aeruginosa*, and *bacillus alvei.*

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the drawings:

DETAILED DESCRIPTION OF PREFERRED EMBODIMENT

Reference will now be made in detail to the preferred embodiments of the present invention, examples of which are illustrated in the accompanying drawings.

Figure 1:
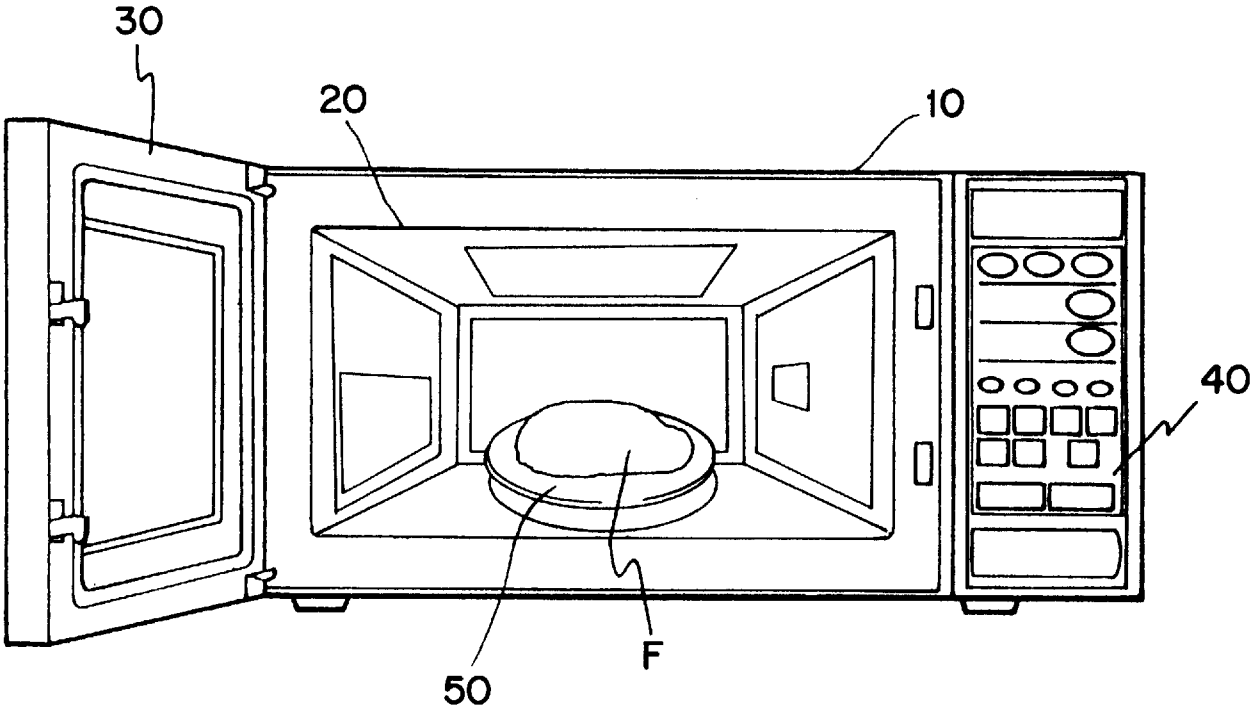
FIG. 1 (PRIOR ART)
FIG. 1 is a perspective view of a conventional microwave oven.
Figure 2:
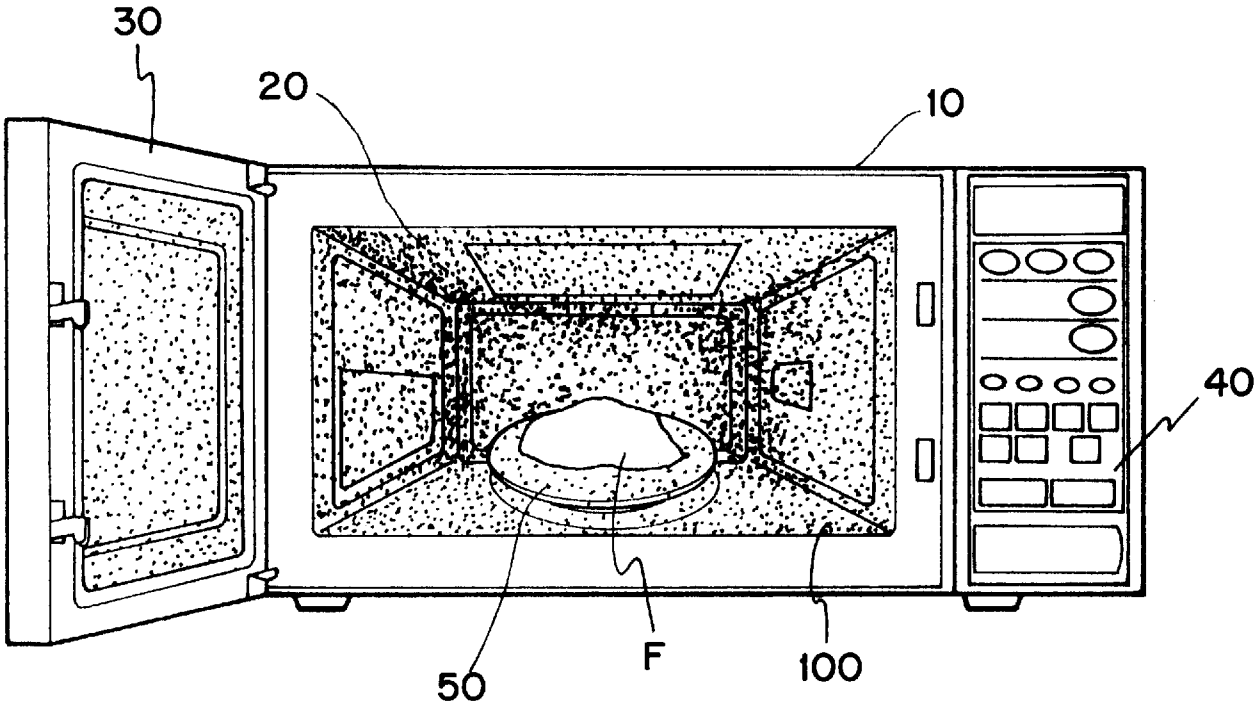
FIG. 2 is a perspective view of the interior of a microwave oven's cooking chamber wherein an antibiotic layer is formed in accordance with the present invention.

Referring to FIG. 2, an antibiotic layer 100 is formed to each of a cooking chamber 20's inner walls, a door 30, and a turntable 50 of a microwave oven, thus killing bacteria bred by food being cooked. More specifically, antibiotic layer 100 is formed on left, right, rear inner walls and ceiling and bottom of cooking chamber 20, and the inner surface of door 30, the outer surface of a turntable 50. Generally, antibiotic layer 100 is formed of zeolite-Ag having an excellent antibiotic effect, thus preventing the propagation of green mold. Zeolite-Ag is a heat resistant mineral, and when applying heat of 300° C. to it, it is not discolored. In addition, it is quite stable with respect to the water or organic solvent, and has an antibiotic effect for a long period of time.

This mineral antibiotic material kills *escherichia coli, salmonella typhimurium, pseudomonas aeruginosa*, and *bacillus alvei* and prevents the propagation of mold, thus being effective in areas of high temperature and high humidity. The *escherichia coli* are non-pathogenic microbes, the type species of the genus, occurring as part of the normal intestinal flora in vertebrates. The *escherichia coli* are used as a contamination index of food sanitation check. We may easily suffer from food poisoning due to intake of food contaminated by bacteria or poisonous substances produced by bacteria in the summer.

The salmonella are enterobacteria that are pathogenic for humans and other warm-blooded animals and cause food poisoning, gastrointestinal inflammation, typhoid fever, or septicemia.

The *bacillus alvei* are one of aerobic rod-shaped gram-positive bacteria producing endospore that do not thicken the rod and including many saprophytes and some parasites. They exist in the soil, hay, brooks, the surface of soybean paste or soysauce, milk, etc. They curdle milk, break starch into simple sugars, and resolve oil and fat. They quickly propagate themselves by fission, and have a strong heat resistance, preventing conjunctivitis.

The following test was conducted to check the antibiotic effect of the inventive microwave oven.

[Result]

A sample coated with the antibiotic material according to the present invention and samples of conventional microwave ovens, a control group, were prepared in 10 cm×10 cm.

*Escherichia coli* KCTC1116, *pseudomonas aeruginosa* KCTC1750, and *salmonella typhimurium* KCTC1926 were used as test strains.

The above three test strains, each held in a slant medium, were inoculated to a 10 ml liquid medium containing substances of table 1 and were cultivated in the liquid medium at 37° C. for 18 hours, thus obtaining a preculture fluid.

The preculture fluid was diluted with a sterilized phosphate buffer solution (0.2 mole, pH7), so that each strain of $10^3$ to $10^4$ was contained in the 10 ml liquid medium. The 90 ml phosphate buffer solution (0.2 mole, pH7) was put in a divided triangular flask of 250 ml as a test liquid.

A 70 ml buffer solution for cultivation was separated in the triangular flask of 250 ml, and the test liquid of 5 ml was separated. The above samples were each added to the test strains to make test culture liquids. After shaking and mixing the test culture liquids well, $10^{-1}$, $10^{-2}$, and $10^{-3}$ solutions were made as a buffer solution for dilution with a part (1 ml) of the respective test culture liquids. Each buffer solution of 1 ml was mixed with a medium of 20 ml containing substances of table 2 in a petri dish, and then hardened. Each of them was cultivated in a culture medium of 37° C. for 24 hours, and the number of colonies of each test strain was counted and the counted number was calculated back by a multiple of dilution. A resultant value was an initial number.

The test culture liquids were shake-cultured in a water bath of 30° C. by 140 rpm. When 24 hours elapsed during cultivation, $10^{-1}$, $10^{-2}$, and $10^{-3}$ solutions were made as a buffer solution for dilution with a part (1 ml) of the respective test culture liquids. According to the above colony counting method, the number of colonies of each petri dish was counted, and the counted number was calculated back by a multiple of dilution. A resultant value was the number of colonies cultivated per hour.

Table 3 shows the result from the test conducted to compare the inventive microwave oven with the control group of the conventional microwave ovens in antibiotic effect.

[Nutrient Broth]

TABLE 1

| Ingredient | Content |
|---|---|
| Beef extract | 3 g |
| Peptone | 5 g |
| Distilled water | 100 ml (pH 7) |

TABLE 2

[Nutrient Broth]

| Ingredient | Content |
|---|---|
| Beef extract | 3 g |
| Peptone | 5 g |
| Glucose (or dextrose) | 1 g |
| Agar | 15 g |
| Distilled water | 100 ml (pH 7.2) |

TABLE 3

| | Sample | Initial number | After 24 hours |
|---|---|---|---|
| *Escherichia coli* | Control group | $3.42 \times 10^5$ | $6.80 \times 10^5$ |
| | This invention | $3.42 \times 10^5$ | <1 |
| *Pseudomonas aeruginosa* | Control group | $7.50 \times 10^5$ | $2.20 \times 10^4$ |
| | This invention | $7.50 \times 10^5$ | <1 |
| *Salmonella typhimurium* | Control group | $5.20 \times 10^5$ | $5.90 \times 10^5$ |
| | This invention | $5.20 \times 10^5$ | <10 |

The microwave oven of the invention has an antibiotic effect superior to the control group's as appeared in Table 3.

As described above, the antibiotic microwave oven of the present invention includes an antibiotic layer formed on each of all the inner walls forming the cooking chamber, thus preventing foodstuffs cooked in the cooking chamber from being contaminated by various microbes.

It will be apparent to those skilled in the art that various modifications and variations can be made in the antibiotic microwave oven of the present invention without departing from the spirit or scope of the invention. Thus, it is intended that the present invention cover the modifications and variations of this invention provided they come within the scope of the appended claims and their equivalents.

What is claimed is:

1. An antibiotic microwave oven comprising a cooking chamber and a magnetron for cooking a foodstuff within the cooking chamber utilizing high frequency energy, comprising an antibiotic layer formed on walls of the cooking chamber for killing bacteria within the cooking chamber and for preventing the propagation therein of harmful microbes, wherein the antibiotic layer is formed of zeolite-Ag, for killing *escherichia coli, salmonella typhimurium, pseudomonas aeruginosa*, and *bacillus alvei*.

* * * * *